US012781997B2

(12) United States Patent
Thaisatian et al.

(10) Patent No.: US 12,781,997 B2
(45) Date of Patent: Nov. 3, 2026

(54) INDOOR UNIT FOR AN AIR CONDITIONER

(71) Applicant: DAIKIN INDUSTRIES (THAILAND) LTD., Chonburi (TH)

(72) Inventors: Weerachart Thaisatian, Chonburi (TH); Uthaiwat Srinoraditlert, Chonburi (TH); Morimoto Kouji, Chonburi (TH); Masahiko Chouji, Chonburi (TH); Hiroki Hayashi, Chonburi (TH)

(73) Assignee: DAIKIN INDUSTRIES (THAILAND) LTD., Chonburi (TH)

( * ) Notice: Subject to any disclaimer, the term of this patent is extended or adjusted under 35 U.S.C. 154(b) by 256 days.

(21) Appl. No.: 18/128,774

(22) Filed: Mar. 30, 2023

(65) Prior Publication Data

US 2023/0243551 A1 Aug. 3, 2023

Related U.S. Application Data

(63) Continuation of application No. PCT/IB2020/060194, filed on Oct. 30, 2020.

(51) Int. Cl.
*F24F 13/20* (2006.01)
*F24F 1/0057* (2019.01)

(52) U.S. Cl.
CPC ..... *F24F 13/20* (2013.01); *F24F 1/0057* (2019.02)

(58) Field of Classification Search
CPC ..... F24F 13/20; F24F 1/0057; F24F 2221/36
USPC ..... 248/690–692, 234, 300; 312/242–248; 165/53–54, 67, 53–57; 454/203–204; 62/262–263
See application file for complete search history.

(56) References Cited

U.S. PATENT DOCUMENTS 2,661,606 A * 12/1953 Trask ..... F24F 13/20 62/428
2,801,582 A * 8/1957 Kuhlenschmidt ..... F24F 11/72 62/409
2,891,389 A * 6/1959 Tull ..... F24F 1/031 62/262
2,893,220 A * 7/1959 Blum ..... F24F 5/001 62/427
2,945,359 A * 7/1960 Macleod ..... F24F 1/031 62/262

(Continued)

FOREIGN PATENT DOCUMENTS

EP 3330632 A1 * 6/2018 ..... F24F 1/0063
JP 11101469 A * 4/1999

OTHER PUBLICATIONS

JP-11101469-A, machine translation (Year: 2025).*

(Continued)

*Primary Examiner* — Eric S Ruppert
*Assistant Examiner* — Kirstin U Oswald
(74) *Attorney, Agent, or Firm* — Osha Bergman Watanabe & Burton LLP

(57) ABSTRACT

An indoor unit for an air conditioner, includes: a main body including a fan and a heat exchanger; a casing that accommodates the main body and is attachable to and detachable from the main body; a front panel that is attachable to and detachable from the casing; and a left side panel and a right side panel that covers side surfaces of the casing, respectively and is attachable to and detachable from the casing.

10 Claims, 7 Drawing Sheets

(56) References Cited

U.S. PATENT DOCUMENTS 3,174,541 A * 3/1965 Brandt ..... F24F 13/20 415/214.1
3,438,219 A * 4/1969 Brugler ..... F24F 1/029 62/448
3,917,757 A * 11/1975 Hoag ..... F24F 6/06 261/92
4,100,764 A * 7/1978 Murano ..... F24F 13/20 62/262
4,426,120 A * 1/1984 Johnson ..... F24F 3/0442 312/107
4,733,542 A * 3/1988 Blair ..... F24F 1/005 62/298
5,373,894 A * 12/1994 Tomatsuri ..... F24F 1/0057 165/122
5,685,166 A * 11/1997 Li ..... F25D 23/006 62/428
6,199,393 B1 * 3/2001 Tesche ..... F24F 13/20 62/262
6,206,085 B1 * 3/2001 Correa ..... F28F 9/002 165/122
6,321,553 B1 * 11/2001 Bushnell ..... F24F 1/027 62/262
6,725,684 B2 * 4/2004 Lee ..... F24F 13/1426 62/298
7,757,510 B2 * 7/2010 Rosete ..... F24F 3/0442 52/794.1
10,551,075 B2 2/2020 Kim et al.
2002/0050350 A1 * 5/2002 Moretti ..... F24F 1/027 165/204
2005/0039478 A1 * 2/2005 Yoon ..... F24F 13/20 62/262
2007/0044496 A1 * 3/2007 Ha ..... F24F 13/20 62/262
2008/0035635 A1 * 2/2008 Moffett ..... F24F 13/20 220/4.28
2013/0075056 A1 * 3/2013 Fernandez ..... H05K 7/186 165/45
2015/0075201 A1 * 3/2015 Park ..... F25D 17/04 454/324
2016/0033161 A1 * 2/2016 Koyanagi ..... F24F 1/0068 312/236
2017/0138613 A1 5/2017 Bai et al.
2018/0023820 A1 * 1/2018 Kim ..... F24F 13/30 250/435
2019/0390860 A1 12/2019 Han et al.

OTHER PUBLICATIONS

International Search Report issued in corresponding International Application No. PCT/IB2020/060194 mailed Jul. 28, 2021 (4 pages).
Written Opinion issued in corresponding International Application No. PCT/IB2020/060194 mailed Jul. 28, 2021 (5 pages).

* cited by examiner

INDOOR UNIT FOR AN AIR CONDITIONER

TECHNICAL FIELD

The present disclosure relates to an indoor unit for an air conditioner.

BACKGROUND

It is known that an indoor unit for an air conditioner includes a main body including a fan, a heat exchanger, etc., a casing accommodating the main body, a front panel, a bottom panel, a rear panel, a left side panel and a right side panel, as disclosed in EP Publication of Unexamined Patent Application No. EP3330632A1 hereinafter called PTL 1.

In the indoor unit for the air conditioner described in PTL 1, for the purpose of securing workability at the time of maintenance and improving an aesthetic appearance, the front panel, the bottom panel, the rear panel, the left side panel and the right side panel are detachable from the casing.

However, in the indoor unit for the air conditioner described in PTL 1, since the casing is not able to be detached from the indoor unit which is fixed on the wall, each panel is not able to be detached from the casing in a state that the indoor unit is fixed on the wall. As such, when a service man detaches the panel, the serviceman has to detach the indoor unit from the wall, and then detach the panel from the main body of the indoor unit.

Therefore, the development of an indoor unit for an air conditioner that the service man can easily change each panel as well as the aesthetic appearance of the indoor unit is improved, is required.

PATENT LITERATURE

PTL 1: EP Publication of Unexamined Patent Application No. EP3330632A1

SUMMARY

One or more embodiments of the present disclosure provide an indoor unit for an air conditioner that the service man can easily change each panel as well as that the aesthetic appearance of the indoor unit is improved.

One or more embodiments of the present disclosure provide an indoor unit for an air conditioner comprising: a main body including a fan and a heat exchanger; a casing which accommodates the main body; a front panel which is configured to be attachable to and detachable from the casing; and a left side panel and a right side panel which cover side surfaces of the casing respectively, wherein the casing is configured to be attachable to and detachable from the main body, and wherein the left side panel and the right side panel are configured to be attachable to and detachable from the casing.

According to the embodiments of the present disclosure, firstly, since the casing is configured to be attachable to and detachable from the main body, a service man can detach the casing from the main body of the indoor unit which is fixed on the wall.

Then, the casing which is detached from the main body is put on the floor. As such, it is easier for the service man to check the casing, the front panel, the left side panel and the right side panel, as compared with a condition where the indoor unit is fixed on the wall.

Secondly, the front panel is configured to be attachable to and detachable from the casing as well as the left side panel and the right side panel are configured to be attachable to and detachable from the casing. As such, it is much easier for the service man to change the front panel, the left side panel and/or the right side panel in the condition where the casing is put on the floor.

Thirdly, since the front panel, the left side panel and the right side panel are configured to be attachable to and detachable from the casing, the aesthetic appearance of the indoor unit corresponding to the taste of a user is improved.

Therefore, according to the embodiments of the present disclosure, it is possible that the service man can easily change each panel as well as that the aesthetic appearance of the indoor unit is improved.

In the indoor unit for the air conditioner of the embodiments of the present disclosure, the front panel covers an end part of each of the left side panel and the right side panel, and each of the left side panel and the right side panel is configured to be detachable from the casing by moving it along the side surface of the casing in the direction of the front side of the casing.

According to the embodiments of the present disclosure, unless each of the left side panel and the right side panel is moved along the side surface of the casing in the direction of the front side of the casing, the each of the left side panel and the right side panel is not able to detached from the casing.

Therefore, it is possible to prevent the each of the left side panel and the right side panel from falling down accidentally from the casing before the front panel is detached from the casing.

Additionally, the front panel is fixed to the casing via a first fastening mechanism.

According to the embodiments of the present disclosure, when the front panel is fixed to the casing, it is possible to prevent the front panel from falling down accidentally from the casing securely as well as to prevent the each of the left side panel and the right side panel from falling down accidentally from the casing more securely.

In the indoor unit for the air conditioner of the embodiments of the present disclosure, the indoor unit further comprises a bottom panel which covers a bottom surface of the casing and is configured to be attachable to and detachable from the casing.

According to the embodiments of the present disclosure, since the bottom panel is configured to be attachable to and detachable from the casing, it is much easier for the service man to change the bottom panel. Moreover, by changing the bottom panel, the aesthetic appearance of the indoor unit corresponding to the taste of a user is improved.

In the indoor unit for the air conditioner of the embodiments of the present disclosure, the bottom panel is configured to be detachable from the casing by detaching the left side panel and the right side panel from the casing.

According to the embodiments of the present disclosure, only by detaching the left side panel and the right side panel from the casing, the bottom panel is able to be detached from the casing. Therefore, it is possible to realize the unity of work among the service men as well as to attach easily and securely the bottom panel to the casing by the left side panel and the right side panel.

In the indoor unit for the air conditioner of the embodiments of the present disclosure, a left side part and a right side part of the bottom panel are supported from below by the left side panel and the right side panel respectively.

According to the embodiments of the present disclosure, only by detaching both the left side panel and the right side panel from the casing, the bottom panel is able to be detached from the casing. Therefore, it is possible to prevent the bottom panel from falling down accidentally from the casing before both the left side panel and the right side panel are detached from the casing.

In the indoor unit for the air conditioner of the embodiments of the present disclosure, each of the left side panel and the right side panel is fixed to the casing via a second fastening mechanism.

According to the embodiments of the present disclosure, when the each of the left side panel and the right side panel is fixed to the casing, it is possible to prevent the each of the left side panel and the right side panel from falling down accidentally from the casing more securely.

In the indoor unit for the air conditioner of the embodiments of the present disclosure, the bottom panel is fixed to the casing via a third fastening mechanism.

According to the embodiments of the present disclosure, when the bottom panel is fixed to the casing, it is possible to prevent the bottom panel from falling down accidentally from the casing more securely.

BRIEF DESCRIPTION OF THE DRAWINGS

The principle of the present disclosure and its advantages will become apparent in the following description taking in consideration with the accompanying drawings in which.

DETAILED DESCRIPTION

Hereinafter, one or more embodiments of the present disclosure will be described in detail with reference to the drawings.

An air conditioner includes an indoor unit 1 provided in a room and an outdoor unit (not shown) connected to the indoor unit 1 by piping and provided outside the room. The indoor unit 1 sucks air from the room, adjusts a temperature or humidity thereof and then blows out the air to the room, thereby performing air-conditioning in the room.

Figure 1:
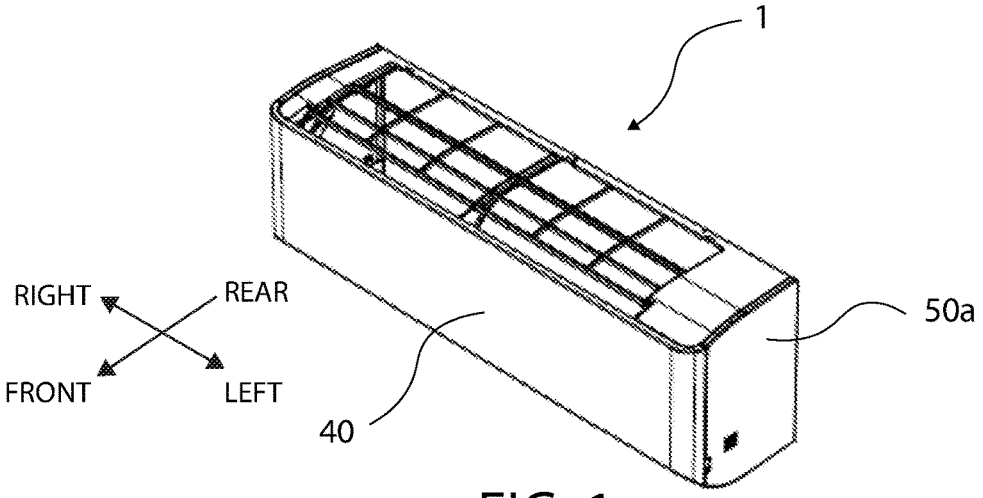
FIG. 1 is a perspective view of an indoor unit 1.
Figure 2:
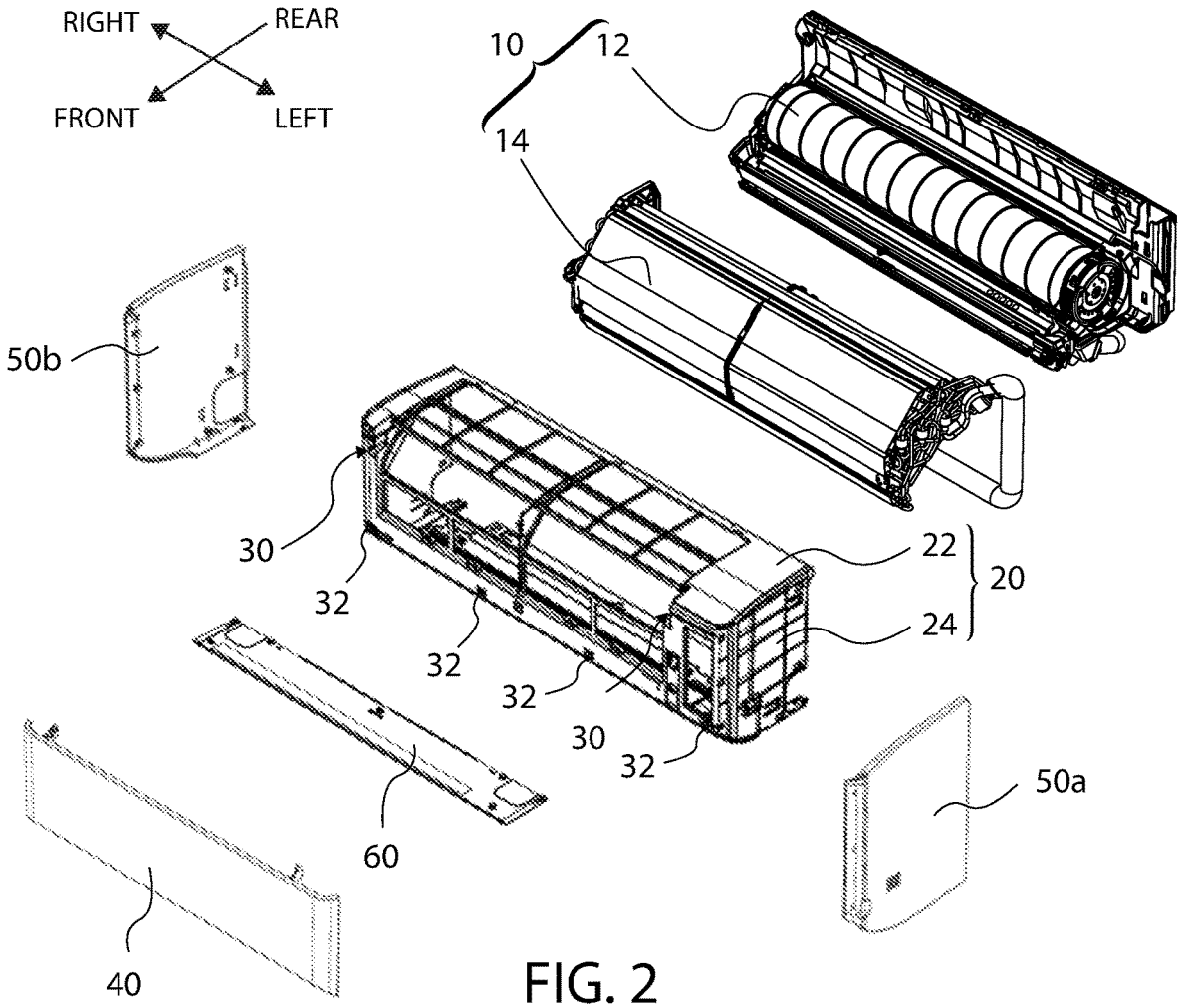
FIG. 2 is a development view of the indoor unit 1.
Figure 3:
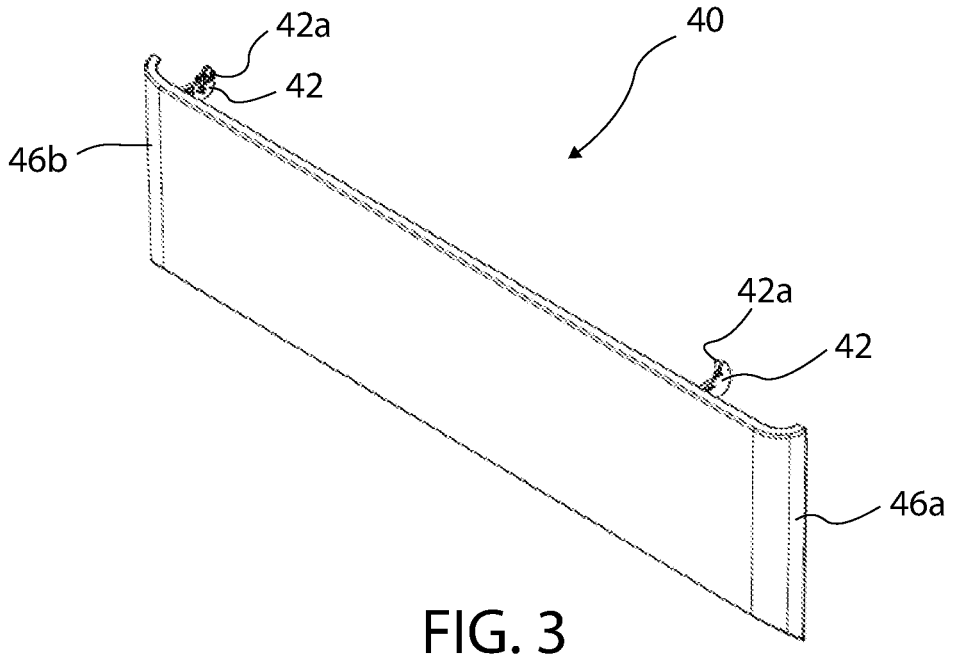
FIG. 3 is a front view of a front panel 40.

As shown in FIG. 1 and FIG. 2, the indoor unit 1 includes a main body 10 including a fan 12, a heat exchanger 14, etc., a casing 20 which accommodates the main body 10, a front panel 40 which covers a front surface of the casing 20, a left side panel 50*a* and a right side panel 50*b* which cover side surfaces of the casing 20 respectively, and a bottom panel 60 which covers a bottom surface of the casing 20.

Here, the front surface, the bottom surface, and the side surfaces which consist of a left surface and a right surface are surfaces expressed with reference to a state in which the indoor unit 1 is installed. Therefore, the front surface is a front side surface of the indoor unit 1, the bottom surface is a surface on the side of the floor of the room, and the side surfaces are right and left surfaces in a lateral direction toward the wall surface sides of the room.

The casing 20 is a member which covers the main body 10 and is formed to open to the rear side of the casing 20 in a state where the indoor unit 1 is fixed on the wall. The casing 20 includes a body portion 22 which is formed in substantially a horizontally elongated rectangular parallelepiped shape having an air inlet port formed at a top surface and the front surface and an air outlet port formed at a lower portion thereof, and side portions 24,24 which are provided on both right and left end sides of the body portion 22. Namely, the casing 20 covers the surfaces of the main body 10 excluding a rear surface of the main body 10.

The casing 20 is configured to be attachable to and detachable from the main body 10, so that a service man can detach the casing 20 from the main body 10 of the indoor unit 1 which is fixed on the wall.

A pair of grooves 30,30 are provided at the front side of the casing 20, and the groove 30 is formed in a shape so that a plate member 42 of the front panel 40 to be described later is insertable into the groove 30. Also, a notch part 30*a* is provided in each of the groove 30, and is formed at a position corresponding to a tip of the plate member 42.

As shown in FIG. 2, plural catch members 32 are provided at the lower portion of the front side of the casing 20, and the catch member 32 is formed as a latching hole. In each catch member 32, a catch member engagement part (not shown) is formed so that a caught member 44 of the front panel 40 to be described later is engaged with the catch member engagement part. The number of the catch members 32 is 4 in FIG. 1, but there is no limit on the number of the catch members 32.

Figure 7:
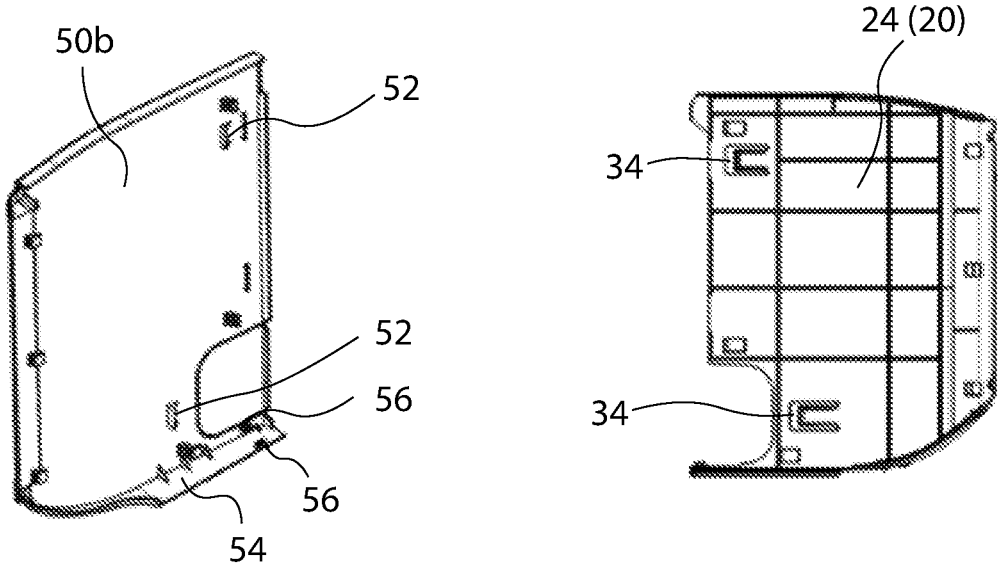
FIG. 7 is the explanation view about the relation between the casing 20 and a right side panel 50*b;*

As shown in FIG. 2 and FIG. 7, the side portion 24 of the casing 20 includes 2 first hooks 34,34. Each first hook 34 is formed in a U-shaped slit so as to open on the front side of the casing 20.

Figure 10:
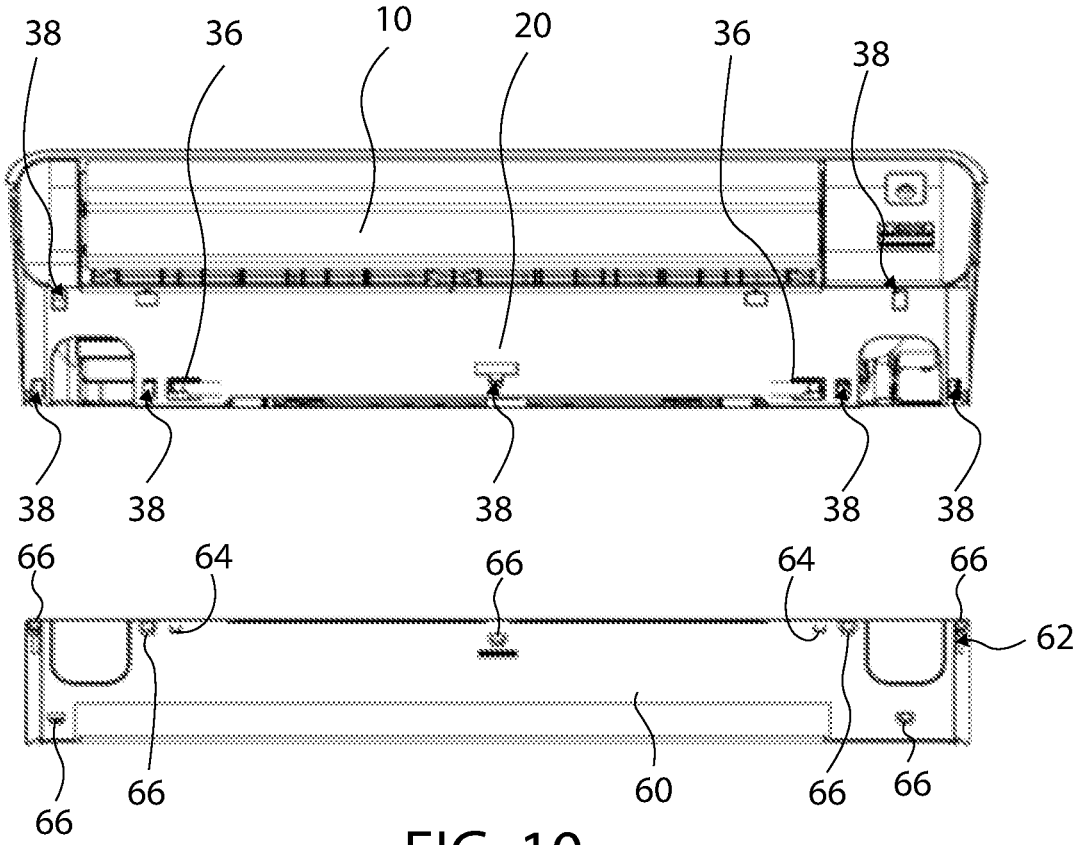
FIG. 10 is the explanation view about the relation between the casing 20 with a main body 10 and the bottom panel 60.
Figure 11:
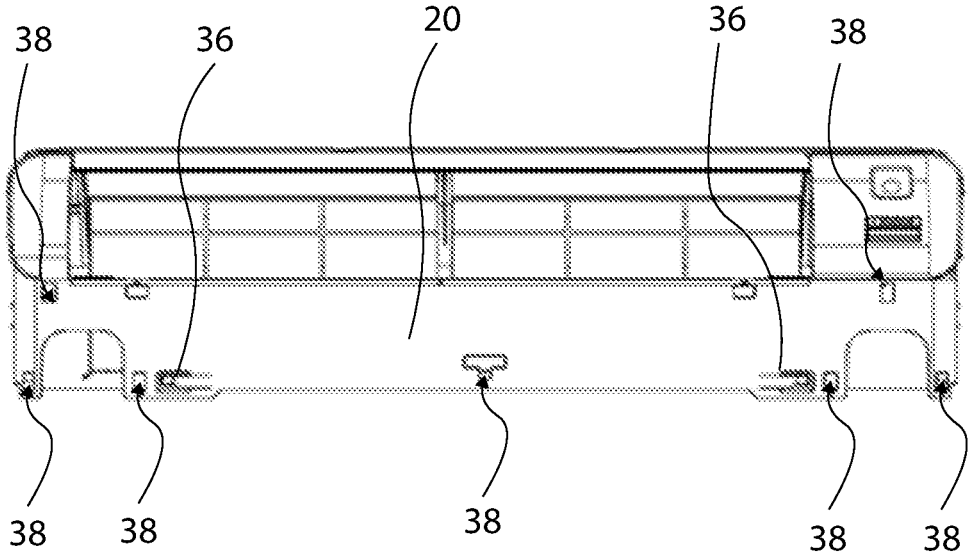
FIG. 11 is the casing 20 when viewed from below.

As shown in FIG. 10 and FIG. 11, the bottom surface of the casing 20 includes a pair of second hooks 36,36. Each of second hooks 36,36 is formed in a U-shaped slit so as to open to a center side of the bottom surface of the casing 20.

As shown in FIG. 1 and FIG. 2, the front panel 40 is configured to be attachable to and detachable from the body portion 22 of the casing 20 to cover a front surface of the casing 20 and to suck the air into the casing 20 through the air inlet port from a space between the front panel 40 and the casing 20.

As described above, the front panel 40 includes the plate member 42 which is insertable into the groove 30 of the casing 20, at the rear side of the front panel 40. Moreover, as shown in FIG. 2 to FIG. 6, a columnar projection 42*a* is provided at the tip of the plate member 42 of the front panel 40, so that the columnar projection 42*a* is engaged with the notch part 30*a* of the groove 30 in a state where the front panel 40 is attached to the casing 20 as well as is rotated along the inside surface of the notch part 30*a*.

As such, since the front panel 40 can be opened simply by rotating the columnar projection 42*a* along the inside surface of the notch part 30*a*. As a result, the left side panel 50*a*, the right side panel 50*b* and the bottom panel 60 can be attached or detached simply by opening the front panel 40 without detaching the front panel 40 from the casing 20.

Figure 4:
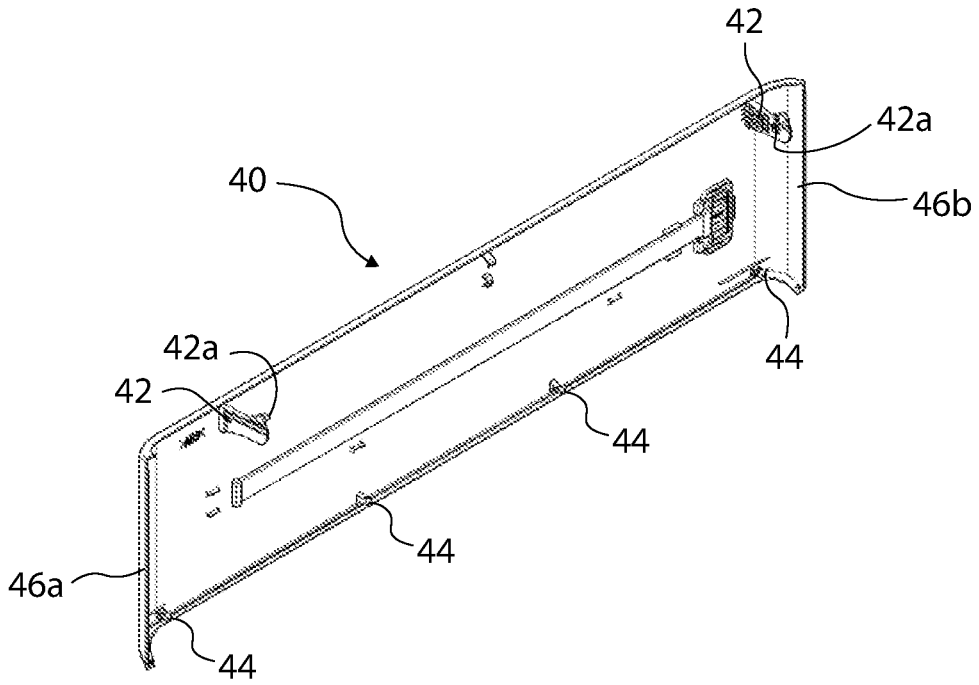
FIG. 4 is a rear view of the front panel 40.
Figure 5:
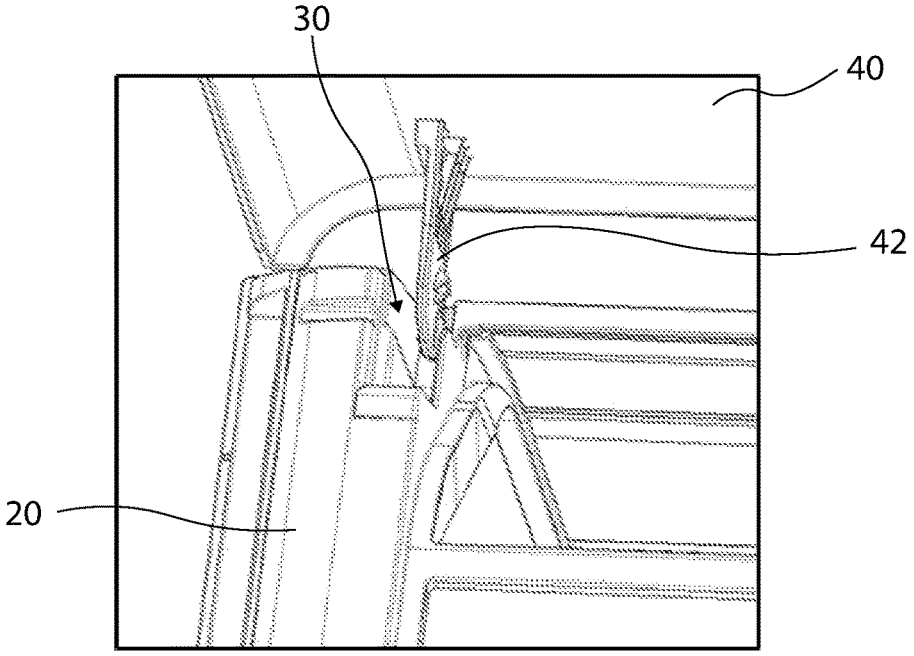
FIG. 5 is an explanation view about an engagement state where the front panel 40 is engaged with a casing 20.
Figure 6:
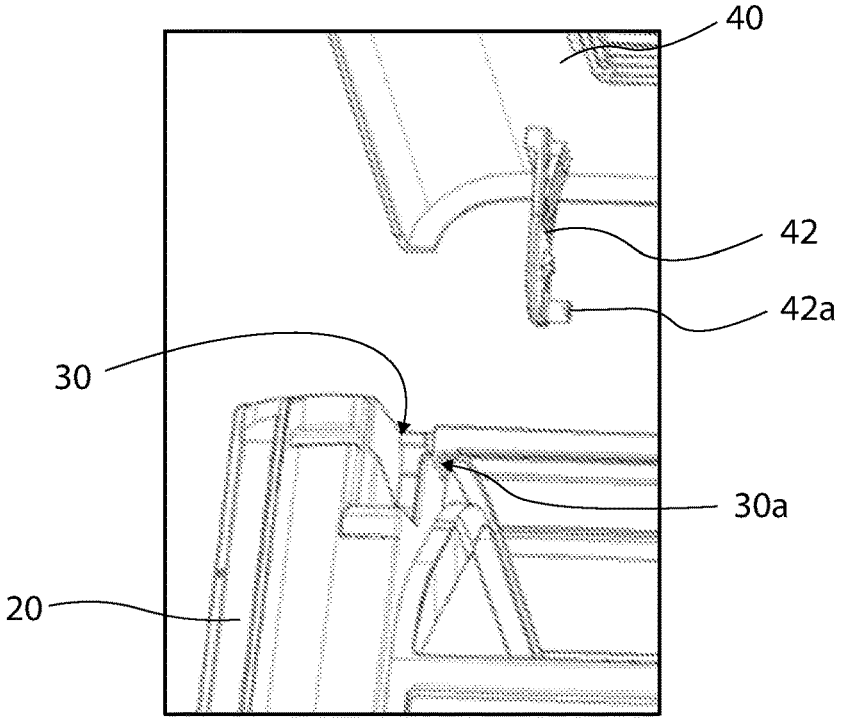
FIG. 6 is the explanation view about a disengagement state where the front panel 40 is not engaged with the casing 20.

As shown in FIG. 4, plural caught members 44, each of which is an "engagement claw", are provided at the lower portion of the rear side of the front panel 40. The caught member 44 is formed to be engaged with the catch member engagement part of the casing 20.

Namely, when the caught member 44 of the front panel 40 is engaged with the catch member engagement part of the catch member 32 of the casing 20, a first fastening mechanism (i.e., first fastener) by the caught member 44 and the catch member 32 is configured between the front panel 40 and the casing 20. Namely, the front panel 40 is fixed to the casing 20 via the first fastening mechanism.

The configuration of the first fastening mechanism is not limited to the caught member 44 and the catch member 32, so long as the front panel 40 is engaged with the casing 20. For example, the second fastening mechanism may be configured by different flexible hook shaped members.

As shown in FIG. 1 to FIG. 4, for the purpose of avoiding the left side panel 50*a* and the right side panel 50*b* from moving to the front side of the casing 20, the front panel 40 includes a left side bending portion 46*a* and a right side bending portion 46*b* at a left side edge part and at a right side edge part respectively. The left side bending portion 46*a* and the right side bending portion 46*b* are formed to be bent backward.

As such, the front panel 40 covers an end part of each of the left side panel 50*a* and the right side panel 50*b* by the left side bending portion 46*a* and the right side bending portion 46*b*, thereby the front panel 40 avoids the left side panel 50*a* and the right side panel 50*b* from moving to the front side of the casing 20. Therefore, it is possible to prevent the each of the left side panel 50*a* and the right side panel 50*b* from falling down accidentally from the casing 20 more securely.

As shown in FIG. 2, the left side panel 50*a* and the right side panel 50*b* are the members that cover the side surface of the casing 20 and configured to be attachable to and detachable from the casing 20.

The left side panel 50*a* and the right side panel 50*b* include first U-shaped protrusions 52,52. For the purpose of preventing each of the left side panel 50*a* and the right side panel 50*b* from falling down accidentally from the casing 20 more securely, each of first U-shaped protrusions 52,52 is formed to be engageable with the first hook 34 of the casing 20 (See FIG. 7).

As such, when the each of the left side panel 50*a* and the right side panel 50*b* is engaged with the first hooks 34,34 of the casing 20, a second fastening mechanism (i.e., second fastener) by the protrusions 52,52 of the left and right side panel 50*a*, 50*b* and the first hook 34 is configured between the left and right side panels 50*a*, 50*b* and the casing 20. Namely, each of the left side panel 50*a* and the right side panel 50*b* is fixed to the casing 20 via the second fastening mechanism.

The configuration of the second fastening mechanism is not limited to the second protrusions 52,52 and the first hook 34, so long as the each of the left side panel 50*a* and the right side panel 50*b* is engaged with the casing 20. For example, the second fastening mechanism may be configured by different flexible hook shaped members.

Moreover, the left side panel 50*a* (the right side panel 50*b*) includes a support portion 54 which supports the left side part (the right side part) of the bottom panel 60 from below. As such, the bottom panel 60 is supported by the support portion 54 as well as arranged sandwiched between the bottom surface of the casing 20 and the support portion 54 of the left side panel 50*a* (the right side panel 50*b*). Therefore, it is possible to prevent the bottom panel 60 from falling down accidentally from the casing 20 before both the left side panel 50*a* and the right side panel 50*b* are detached from the casing 20.

Figure 12:
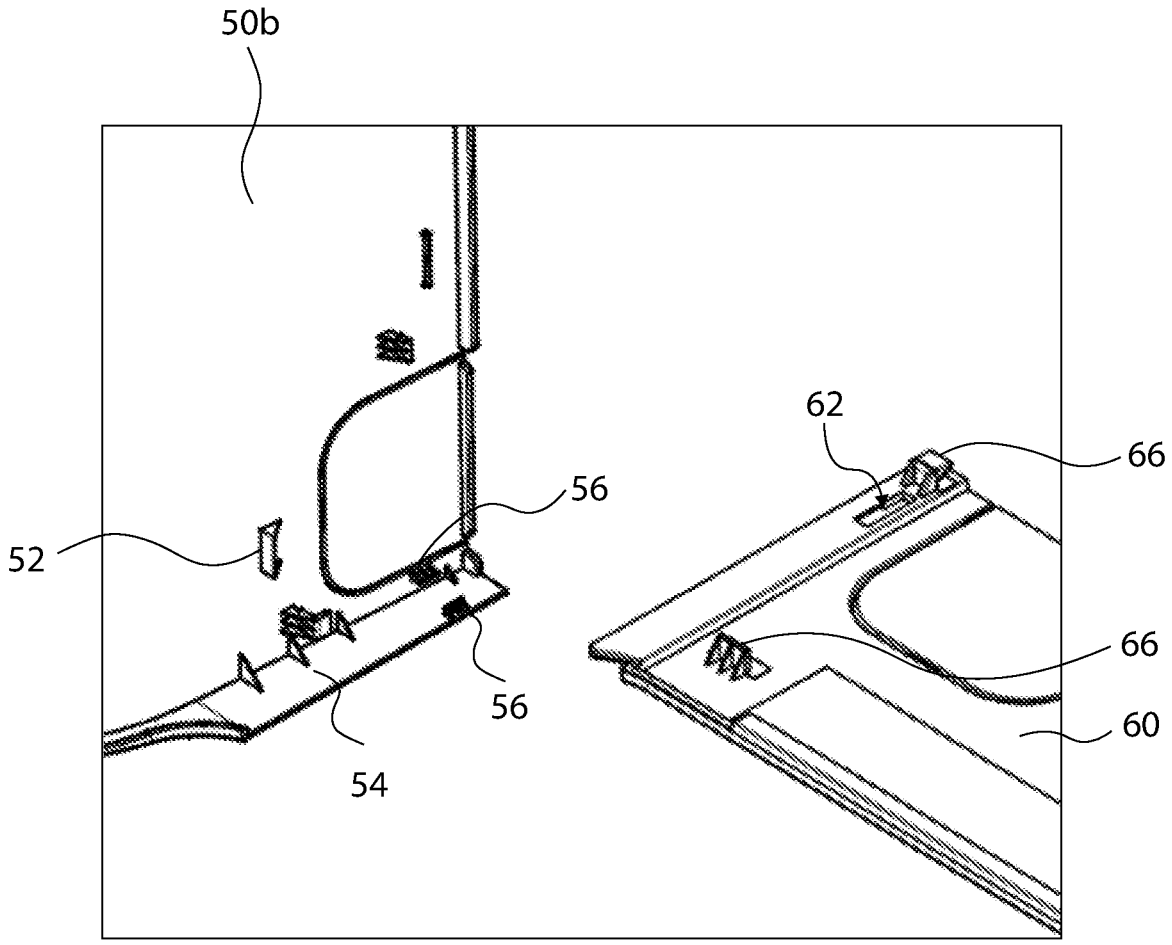
FIG. 12 is the explanation view about the relation between the bottom panel 60 and the right side panel 50*b*.

Furthermore, each of the left side panel 50*a* and the right side panel 50*b* includes a pair of first locking claws 56,56. As shown in FIG. 12, the pair of first locking claws 56,56 are formed to be insertable into an approximately rectangular first locking hole 62 of the bottom panel 60. The first locking hole 62 is formed in the approximately rectangular shape to extend along the short-side direction of the bottom panel 60.

Namely, the first hook 34 is formed in a U-shaped slit so as to open on the front side of the casing 20 as well as the pair of first locking claws 56,56 are formed to be insertable into the approximately rectangular first locking hole 62 of the bottom plate. As such, after the engagement between the first hooks 34,34 of the casing 20 and the first protrusions 52,52 is released, each of the left side panel 50*a* and the right side panel 50*b* can be detachable from the casing 20 by moving it along the side surface of the casing 20 in the direction of the front side of the casing 20.

As a result, unless each of the left side panel 50*a* and the right side panel 50*b* is moved along the side surface of the casing 20 in the direction of the front side of the casing 20, the each of the left side panel 50*a* and the right side panel 50*b* is not able to detached from the casing 20. Therefore, it is possible to prevent the each of the left side panel 50*a* and the right side panel 50*b* from falling down accidentally from the casing 20 before the front panel 40 is detached from the casing 20.

As shown in FIG. 2, FIG. 8 to FIG. 10 and FIG. 12, the bottom panel 60 is a member that covers the bottom surface of the casing 20 and configured to be attachable to and detachable from the casing 20. As such, it is much easier for the service man to change the bottom panel 60. Moreover, by changing the bottom panel 60, the aesthetic appearance of the indoor unit 1 corresponding to the taste of a user is improved.

As described above, the left side part (the right side part) of the bottom panel 60 is supported by the support portion 54 of the left side panel 50*a* (the right side panel 50*b*) from below. As such, the bottom panel 60 is configured to be detachable from the casing 20 by detaching the left side panel 50*a* and the right side panel 50*b* from the casing 20.

As such, only by detaching the left side panel 50*a* and the right side panel 50*b* from the casing 20, the bottom panel 60 is able to be detached from the casing 20. Therefore, it is possible to realize the unity of work among the service men as well as to attach easily and securely the bottom panel 60 to the casing 20 by the left side panel 50*a* and the right side panel 50*b*.

Figure 8:
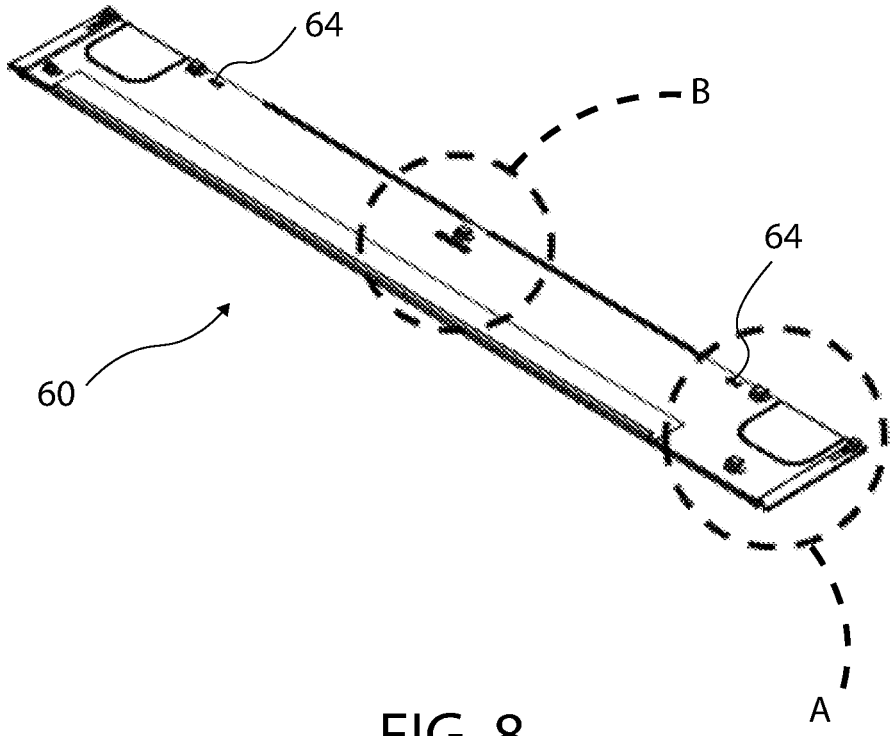
FIG. 8 is a perspective view of a bottom panel 60.
Figure 9A:
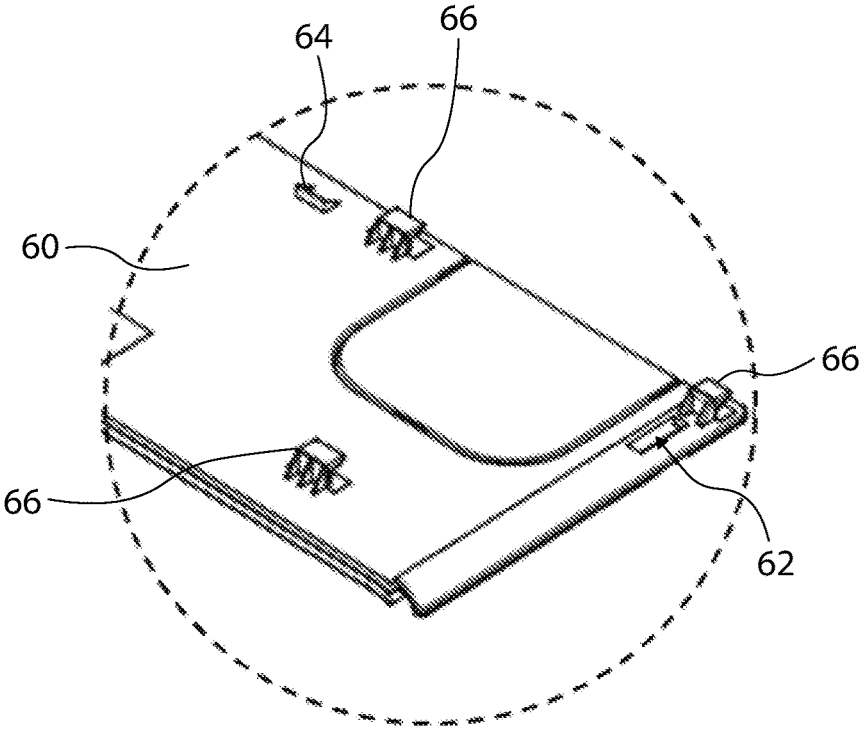
FIG. 9A is an enlarged view of a portion A encircled with a broken line, in FIG. 8.

Moreover, as shown in FIG. 8, FIG. 9A and FIG. 10, the bottom panel 60 includes second protrusions 64,64 which are engaged with the second hooks 36,36 of the casing 20 respectively.

As such, when the second protrusions 64,64 of the bottom panel 60 are engaged with the second hooks 36,36 of the casing 20, a third fastening mechanism (i.e., third fastener) by the second protrusion 64 and the second hook 36 is configured between the bottom panel 60 and the casing 20. Namely, the bottom panel 60 is fixed to the casing 20 via a third fastening mechanism. Therefore, it is possible to prevent the bottom panel 60 from falling down accidentally from the casing 20 more securely.

The configuration of the third fastening mechanism is not limited to the second protrusion 64 and the second hook 36, so long as the bottom panel 60 is engaged with the casing 20.

For example, the third fastening mechanism may be configured by different flexible hook shaped members.

Figure 9B:
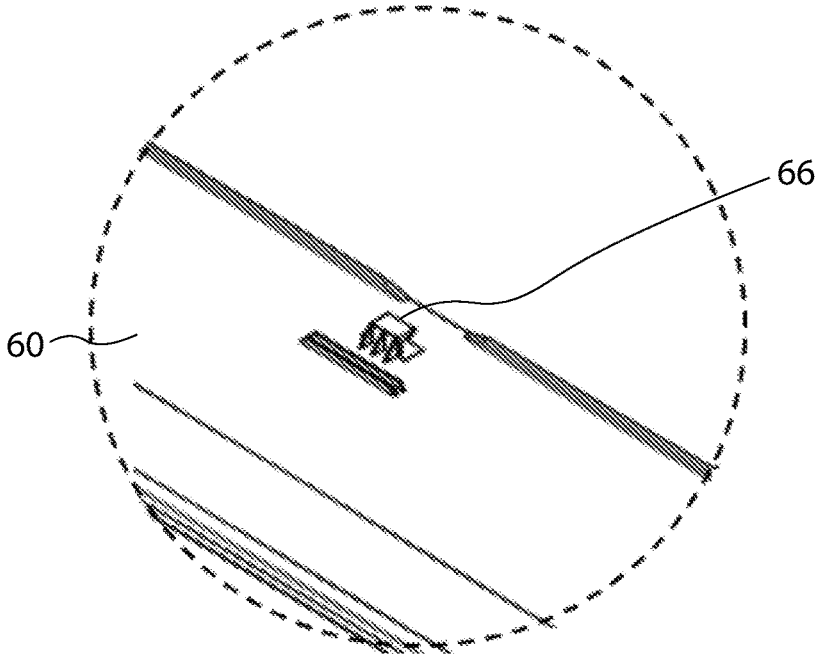
FIG. 9B is an enlarged view of a portion B encircled with a broken line, in FIG. 8.

Furthermore, as shown in FIG. 8 to FIG. 10, the bottom panel 60 includes second locking claws 66 which are formed to be engaged with second locking holes 38 of the bottom surface of the casing 20. The second locking claw 66 is formed in an approximately L-shaped cross section, so as to raise from the bottom panel 60. The tip of the second locking claw 66 is formed to be directed toward the rear side of the casing 20 in a state where the bottom plate is attached to the casing 20. The second locking hole 38 of the bottom surface is formed in the approximately rectangular shape to extend along the short-side direction of the casing 20.

As such, when the bottom panel 60 is detached from the casing 20, the bottom panel 60 can be detached from the casing 20 by moving the bottom panel 60 along the bottom surface of the casing 20 in the direction of front side of the casing 20.

Next, a method for detaching the panels from the indoor unit 1 is described in details with reference to FIG. 2 to FIG. 12.

Normally, the indoor unit 1 is attached on the upper portion of the wall in the room. Firstly, for the purpose of improving the aesthetic appearance of the indoor unit 1 by changing each panel, the casing 20 with the panels 40, 50*a*, 50*b*, 60 is detached from the main body 10 of the indoor unit 1 which is fixed on the wall. Since the casing 20 is configured to be detachable from the main body 10, a service man can detach the casing 20 from the main body 10 of the indoor unit 1 which is fixed on the wall.

Secondly, the casing 20 which is detached from the main body 10 is put on the floor. As such, it is easier for the service man to check the casing 20, the front panel 40, the left side panel 50*a*, the right side panel 50*b* and the bottom panel 60, as compared with a condition where the indoor unit 1 is fixed on the wall.

The front panel 40 includes the left side bending portion 46*a* and the right side bending portion 46*b* at a left side edge part and at a right side edge part respectively. Since the left side bending portion 46*a* and the right side bending portion 46*b* are formed to be bent backward and to cover an end part of each of the left side panel 50*a* and the right side panel 50*b*, the front panel 40 avoids the left side panel 50*a* and the right side panel 50*b* from moving to the front side of the casing 20.

Moreover, the engagement between the first hooks 34,34 of the casing 20 and the first U-shaped protrusions 52,52 of the left and right side panels 50*a*, 50*b*, the engagement between the first locking claws 56,56 of the left and right side panels 50*a*, 50*b* and the first locking hole 62 of the bottom panel 60, the engagement between the second locking holes 38 of the casing 20 and the second locking claws 66 of the bottom panel 60, and the engagement between the second hooks 36,36 of the casing 20 and the second protrusions 64,64 of the bottom panel 60 are formed.

As such, while the casing 20 with the front panel 40, the left side panel 50*a*, the right side panel 50*b*, and the bottom panel 60 is moved from the attached position to the floor, it is possible to prevent each of the front panel 40, the left side panel 50*a*, the right side panel 50*b*, and the bottom panel 60 from falling down accidentally from the casing 20 more securely, Thirdly, in case that front panel 40 is changed, since the front panel 40 is configured to be detachable from the casing 20, the front panel 40 is detached from the casing 20, by releasing the engagement between the catch members 32 of the casing 20 and the caught member 44 of the front member.

On the other hand, in case that front panel 40 is not changed, the front panel 40 is opened simply by rotating the columnar projection 42*a* of the front panel 40 along the inside surface of the notch part 30*a* of the casing 20, by releasing the engagement between the catch members 32 of the casing 20 and the caught member 44 of the front member.

In any case, the left side bending portion 46*a* and the right side bending portion 46*b* of the front panel 40 do not cover an end part of each of the left side panel 50*a* and the right side panel 50*b*, thereby the left side panel 50*a* and the right side panel 50*b* can be movable along the side surface of the casing 20 in the direction of the front side of the casing 20.

Fourthly, the left side panel 50*a* and/or the right side panel 50*b* is detached from the casing 20 by releasing the engagement between the first hooks 34,34 of the casing 20 and the first U-shaped protrusions 52,52 of the left side panel 50*a* and/or the right side panel 50*b*.

Then, by moving the left and the right side panels 50*a*, 50*b* along the side surface of the casing 20 in the direction of the front side of the casing 20 and releasing the engagement between the first locking claws 56,56 of the left and right side panels 50*a*, 50*b* and first locking hole 62 of the bottom panel 60, the left and right side panels 50*a*, 50*b* are detached from the casing 20.

In case that each of the left and the right side panels 50*a*, 50*b* is moved along the side surface of the casing 20 in the direction of the front side of the casing 20, the each of the left and right side panels 50*a*, 50*b* is detached from the casing 20.

Finally, by releasing the engagement between the second hooks 36,36 of the casing 20 and the second licking claws 64,64 of the bottom panel 60, and then by moving the bottom panel 60 along the bottom surface of the casing 20 in the direction of front side of the casing 20, the bottom panel 60 is detached from the casing 20.

The casing 20 with the front panel 40, the left side panel 50*a*, the right side panel 50*b*, and the bottom panel 60 is attached to the main body 10 by a reverse procedure.

Namely, in a state where the front panel 40 is opened or detached from the casing 20, after the bottom panel 60 is attached to the casing 20, the left side panel 50*a* and the right side panel 50*b* are attached to the casing 20. After that, the front panel 40 is firmly attached to the casing 20.

After the casing 20 to which the front panel 40, the left and right side panels 50*a*, 50*b* and the bottom panel 60 is attached is assembled, the assembled casing 20 is attached to the main body 10 which is fixed on the wall.

According to the indoor unit 1, since the front panel 40, the left and right side panels 50*a*, 50*b* and the bottom panel 60 are configured to be attachable to and detachable from the casing 20, it is much easier for the service man to change the front panel 40, the left side panel 50*a* and/or the right side panel 50*b* and the bottom panel 60 in the condition where the casing 20 is put on the floor. As such, the aesthetic appearance of the indoor unit 1 corresponding to the taste of a user is improved.

Therefore, it is possible that the service man can easily change each panel as well as that the aesthetic appearance of the indoor unit 1 is improved.

Moreover, only by detaching the left side panel 50*a* and the right side panel 50*b* from the casing 20, the bottom panel 60 is able to be detached from the casing 20. Therefore, it is possible to realize the unity of work among the service men as well as to attach easily and securely the bottom panel 60 to the casing 20 by the left side panel 50*a* and the right side panel 50*b*.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: indoor unit
10: main body
12: fan
14: heat exchanger
20: casing
22: body portion
24: side portion
30: groove
30*a*: notch part
32: catch member
34: first hook
36: second hook
38: second locking hole
40: front panel
42: plate member
42*a*: projection
44: caught member (engagement claw)
46*a*: left side bending portion
46*b*: right side bending portion
50*a*: left side panel
50*b*: right side panel
52: first protrusion
54: support portion
56: first locking claw
60: bottom panel
62: first locking hole
64: second protrusion
66: second locking claw

What is claimed is:

1. An indoor unit for an air conditioner, comprising:
a main body comprising a fan and a heat exchanger;
a casing that accommodates the main body and has a rear side opening;
a left side panel and a right side panel that each cover a respective side surface of the casing; and
a front panel that covers an end part of the left side panel and an end part of the right side panel, wherein
a rear side of the main body is attached, through the rear side opening of the casing, to a wall of an indoor room to be air-conditioned,
the casing is attachable to and detachable from the main body with the main body being attached to the wall at the rear side,
the front panel is attachable to and detachable from the casing with the main body being attached to the wall at the rear side,
the left side panel and the right side panel are attachable to and detachable from the casing with the main body being attached to the wall at the rear side,
each of the left side panel and the right side panel is detachable from the casing by moving along a corresponding one of the side surfaces of the casing in a direction toward a front side of the casing,
the casing comprises hooks,
the left side panel and the right side panel each comprise a protrusion, and
each of the left side panel and the right side panel is fixed to the casing only by engaging the protrusion with a corresponding one of the hooks.

2. The indoor unit according to claim 1, wherein the front panel is fixed to the casing via a fastener.

3. The indoor unit according to claim 1, further comprising a bottom panel that covers a bottom surface of the casing and is attachable to and detachable from the casing.

4. The indoor unit according to claim 3, wherein the bottom panel is detachable from the casing by detaching the left side panel and the right side panel from the casing.

5. The indoor unit according to claim 4, wherein
the left side panel is in contact with and supports a bottom surface of a left side part of the bottom panel, and
the right side panel is in contact with and supports a bottom surface of a right side part of the bottom panel.

6. The indoor unit according to claim 1, wherein a bottom panel is fixed to the casing via a fastener.

7. An indoor unit for an air conditioner, comprising:
a main body that
comprises:
a fan; and
a heat exchanger;
a casing that:
accommodates the main body,
has an open rear side through which a rear side of the main body is attached to a wall of an indoor room to be air-conditioned, and
is attachable to and detachable from the main body with the main body being attached to the wall;
a front panel that is attachable to and detachable from the casing with the main body being attached to the wall; and
a left side panel and a right side panel that:
cover side surfaces of the casing, respectively, and
are attachable to and detachable from the casing with the main body being attached to the wall, wherein
the front panel covers an end part of each of the left side panel and the right side panel, and
each of the left side panel and the right side panel is detachable from the casing by moving along a corresponding one of the side surfaces of the casing in a direction toward a front side of the casing.

8. The indoor unit according to claim 7, wherein the casing comprises:
a body portion that is in a horizontally elongated rectangular parallelepiped shape; and
side portions on respective right and left sides of the body portion.

9. The indoor unit according to claim 8, wherein the body portion and the side portions are integrally formed.

10. The indoor unit according to claim 7, wherein the casing is configured to be attached to and detached from the main body through the open rear side of the casing.

* * * * *